United States Patent [19]

Chiodi

[11] 4,172,309

[45] Oct. 30, 1979

[54] METHOD OF CORRECTING DEFLECTION DEFOCUSING IN SELF-CONVERGED COLOR CRT DISPLAY SYSTEMS

[75] Inventor: Wayne R. Chiodi, Northbrook, Ill.

[73] Assignee: Zenith Radio Corporation, Glenview, Ill.

[21] Appl. No.: 927,246

[22] Filed: Jul. 21, 1978

[51] Int. Cl.[2] ..... H01J 9/44

[52] U.S. Cl. ..... 29/25.16; 315/368; 316/26

[58] Field of Search ..... 316/26; 29/25.15, 25.16; 313/409, 411, 412; 315/13 C, 368

[56] References Cited

U.S. PATENT DOCUMENTS

| | | | |
|---|---|---|---|
| 3,800,176 | 3/1974 | Gross et al. | 313/412 |
| 3,881,136 | 4/1975 | Scheele | 313/453 |
| 3,975,766 | 8/1976 | Sano et al. | 315/368 |
| 3,984,723 | 10/1976 | Gross et al. | 313/412 |
| 3,995,194 | 11/1976 | Blacker, Jr. et al. | 313/449 |
| 4,006,301 | 2/1977 | Bubacz et al. | 358/248 |
| 4,042,857 | 8/1977 | Hovey et al. | 315/368 |
| 4,050,041 | 9/1977 | Schiecke | 335/210 |
| 4,058,753 | 11/1977 | Blacker et al. | 313/449 |
| 4,086,513 | 4/1978 | Evans, Jr. | 313/414 |

*Primary Examiner*—John McQuade
*Attorney, Agent, or Firm*—John H. Coult

[57] ABSTRACT

This disclosure pertains to the production of self-converged color CRT display systems, and in particular to a method of reducing the effects of off-axis deflection defocusing of electron beams in such systems. The disclosed method comprises installing in the neck of each color CRT bulb a three beam in-line-type electron gun whose mechanical and electrical design parameters are such that the beams in their free fall state have a selected nominal value of underconvergence at the screen which is such that substantially the entire population of production tubes is underconverged. On the neck of each tube is installed a self-converging yoke which establishes, in addition to main deflection magnetic field components, an astigmatic field component which self-converges said beams, but which undesirably introduces astigmatic deflection defocusing of the beams when deflected off the tube axis. Static convergence of said beams at said screen is effected by establishing a static astigmatic quadrupolar magnetic field component common to all three beams and opposite to said astigmatic yoke field component which, while accomplishing the desired static beam convergence, deliberately introduces an astigmatic distortion of said beams. The distortion is a function, for each tube, of the free fall underconvergence value for that tube and at least partially compensating the deflected beams for the deflection defocusing of the beams by the oppositely directed astigmatic yoke field component.

3 Claims, 21 Drawing Figures

Fig. 1
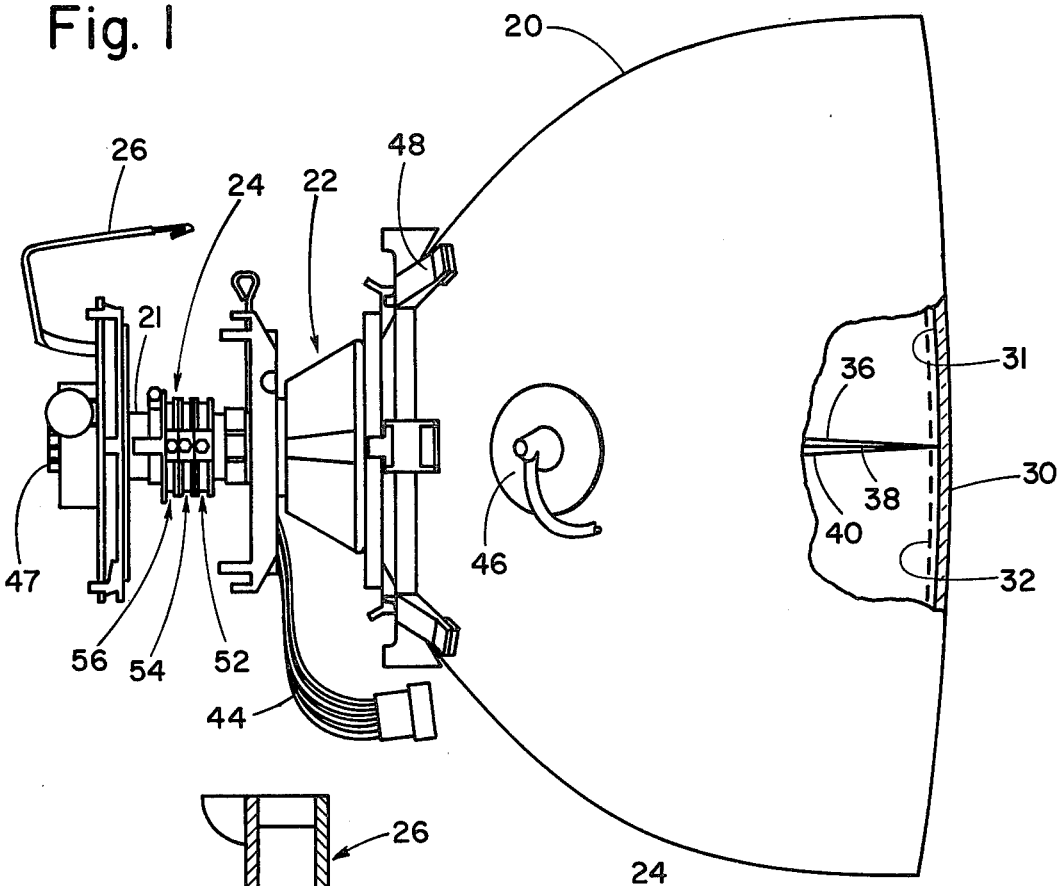
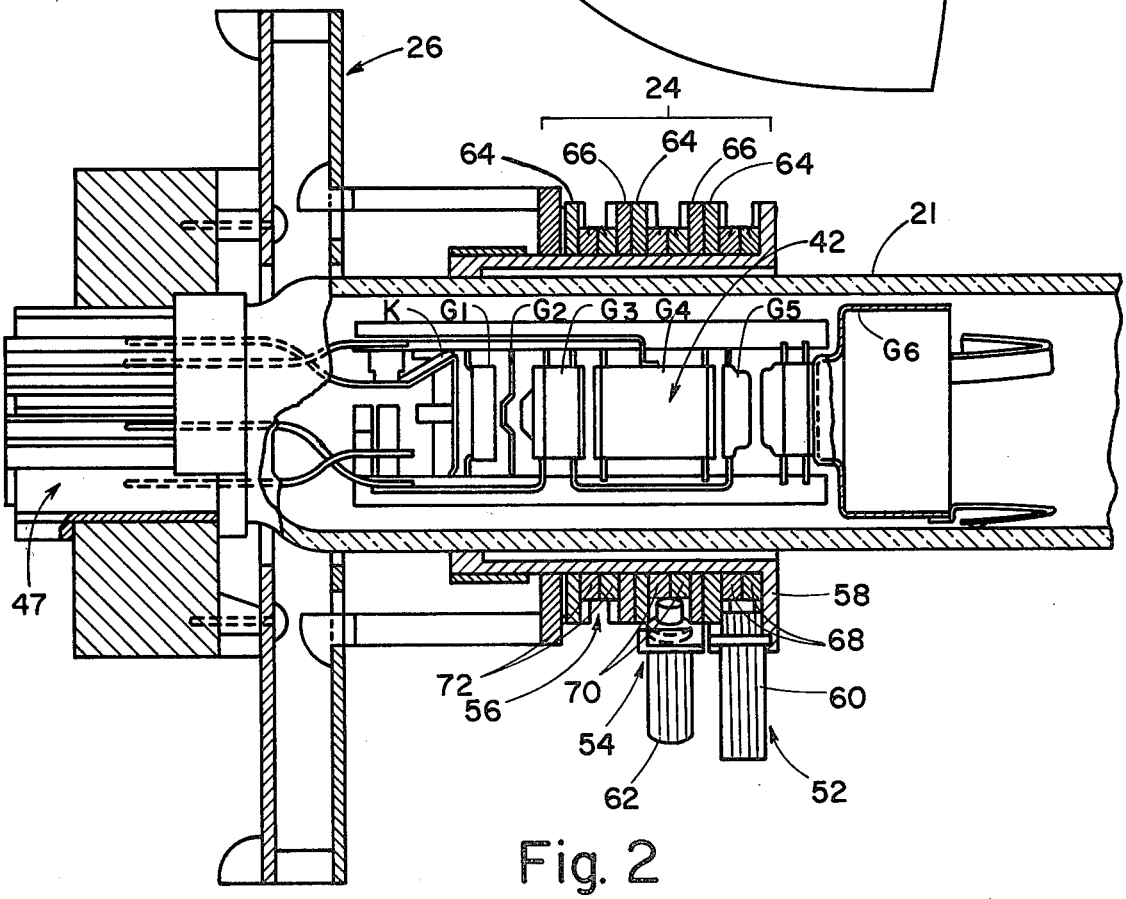
Fig. 2

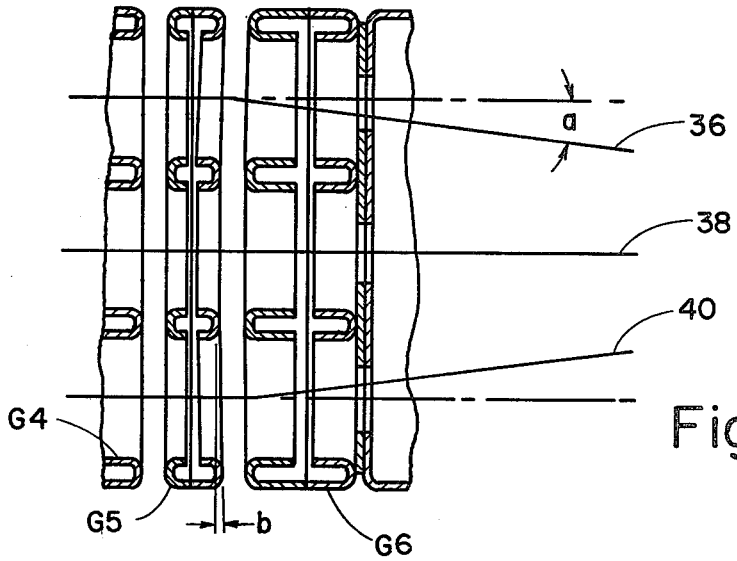
Fig. 3
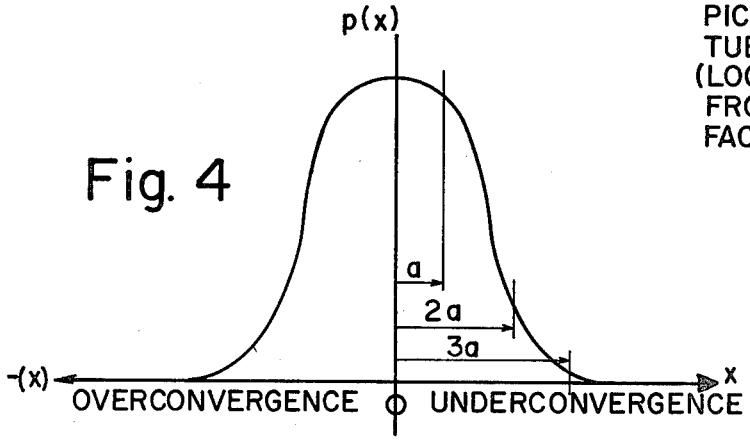
Fig. 4
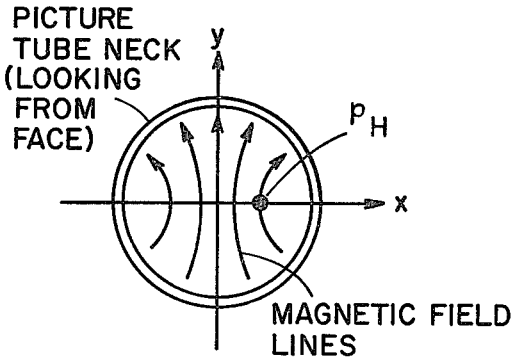
Fig. 5
Fig. 6
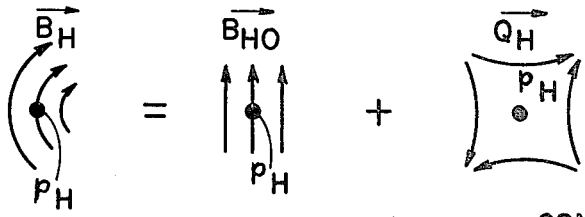
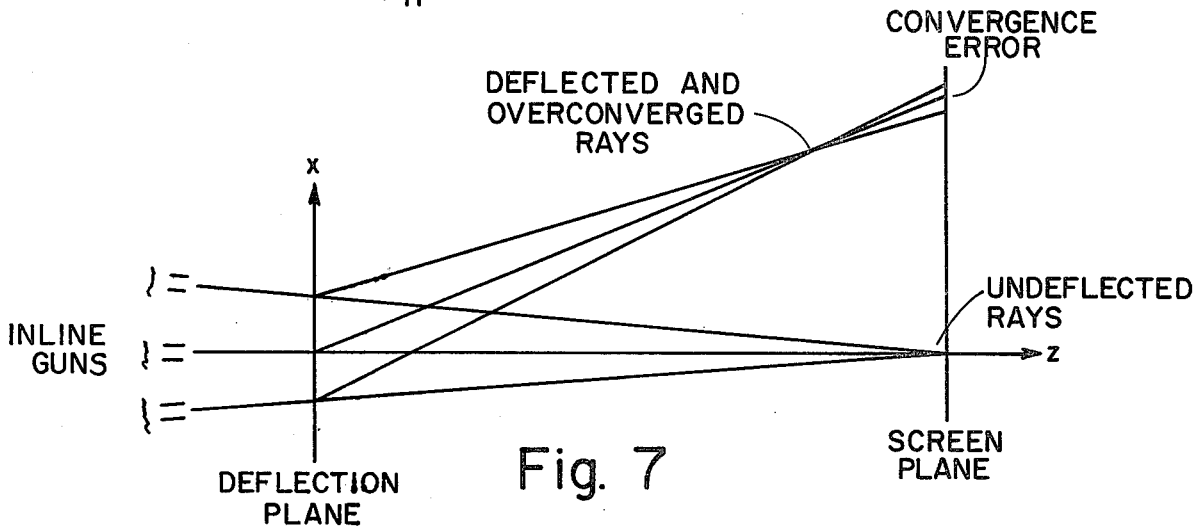
Fig. 7

METHOD OF CORRECTING DEFLECTION DEFOCUSING IN SELF-CONVERGED COLOR CRT DISPLAY SYSTEMS

BACKGROUND OF THE INVENTION AND PRIOR ART STATEMENT

This invention is related to color CRT display systems, in particular, those of the "self-converged" or "self-converging" types. These are systems in which the three electron guns, one each for red, blue and green picture information, are arranged horizontally "in-line". The deflection yoke has, in addition to the main deflection field components, an additional quadrupolar component which maintains the beams in convergence as they are deflected across the screen, without the need for dynamic convergence circuitry.

The theory and construction of self-converged type CRT color display systems are well-known and are described in the literature. For example, see U.S. Pat. No. 3,800,176.

Display systems of the self-converged type permit the use of greatly simplified convergence apparatus, and thus have the advantage of substantially reduced cost. Self-converged systems do, however, have the drawback that the same astigmatic yoke field component which so advantageously self-converges the beams, unfortunately produces rather severe deflection defocusing of the electron beams at the sides of the CRT screen. One of the effects of this defocusing appears as horizontal elongation of the beam spots.

Various approaches have been taken to reduce the real or apparent effects of this deflection defocusing of the beams at the screen edges. One approach is described in U.S. Pat. No. 3,984,723. It involves the provision of vertically oriented elliptical apertures in the $G_2$ electrode of the gun. By causing the beam to have a vertically elliptical shape at the screen center, that is, a shape which is orthogonal to the horizontal beam deflection defocusing produced at the screen edges by the astigmatic yoke field components, some compensation for the deflection defocusing results. There are a number of drawbacks to this approach, however. First, it is believed that the amount and perhaps even the direction of the ellipticity induced in the beam changes as a function of beam current. Secondly, the gun is apt to be incapable of being standardized for a range of tube sizes, being limited for a given design to a particular CRT size and configuration. Another example of this approach is found in U.S. Pat. No. 3,881,136.

Thirdly, it is known that any gun having apertures which are not round is difficult to assemble. The conventional method for assembling and precisely aligning electron gun parts involves stacking them on rod-like mandrels and then joining the parts together by the use of molten glass rods. Any part having a noncylindrical hole cannot be precisely aligned on such a rod-like mandrel and thus is difficult to align with respect to the other parts.

Another approach involves forming a round beam in the lower end of the gun as is conventional. In the main focus lens of the gun a quadrupolar astigmatic field component is formed which introduces a vertical elongation of the beams at the screen center. The vertical elongation at least partially compensates for deflection defocusing of the beams.

This latter technique is employed in a non-standard color CRT display system in which three electron guns are arranged to share a common main focus lens. A dynamic quadrupolar magnetic field is established in the main lens which rounds out the beams. This system is described in "25-Inch 114 Degree Trinitron Color Picture Tube And Associated New Developments" by Sony Corporation, IEEE Spring Conference on BTR, June 10, 1974.

This latter-described system offers the advantage of producing no astigmatism in the beam when the yoke field is zero, that is, when the beams are in the center of the screen. It has the disadvantage, however, that in rounding out the beams at the edges of the screen, the size of the beam spots are undesirably increased. It has been found to be necessary in such a system to use dynamic focusing along with the deflection defocusing compensation in order to minimize the spot enlargement at the screen edges. Dynamic focusing is normally not needed in modern day color television receivers.

Yet another approach is described in U.S. Pat. No. 4,086,513-Evans. Evans discloses the use of axial extensions from certain gun electrodes in the region adjacent the beam-passing apertures. The extensions affect the beam-influencing electrostatic fields in such a way as to vertically elongate the electron beams. The vertical elongation is intended to compensate for deflection defocusing of the electron beams.

OBJECTS OF THE INVENTION

A general object of this invention is to provide a method for compensating for deflecting defocusing of the electron beams in self-converged color CRT display systems, and specifically to provide a method for compensating for horizontal beam spot elongation caused by the quadrupolar yoke field component which accomplishes self-convergence.

It is another object to provide such compensation for deflection defocusing at an extremely low cost penalty, if any.

It is yet another object to provide such deflection defocusing compensation without having to modify the gun or to add apparatus to the system or to substantially alter standard manufacturing or set-up methods.

It is still another object to provide a method of compensating for deflection defocusing in self-converged color CRT display systems which is conducive to permitting one electron gun assembly to fit a range of the tube sizes and configurations.

BRIEF DESCRIPTION OF THE FIGURES

FIG. 1 is a plan view, partly broken away, of a color CRT display system with which the method of this invention may be practiced:

FIG. 2 is an enlarged fragmentary sectional view of a neck portion of the FIG. 1 tube, showing otherwise hidden internal components;

FIG. 3 is a schematic view of a portion of the main focus lens of an electron gun assembly shown in FIG. 2 and particularly depicting the manner in which beam convergence is effected by the gun assembly;

FIGS. 4–19 are figures useful in understanding a theoretical discussion of the nature and causes of the astigmatic deflection defocusing of deflected beams in a color CRT display system of the in-line self-converged type; FIG. 20 is in terms of measured value of free fall underconvergence of production tubes and FIG. 21 is in terms of compensation for deflection defocusing at the screen edges which is afforded by the practice of this invention.

DESCRIPTION OF THE PREFERRED EMBODIMENT

Figure 9:
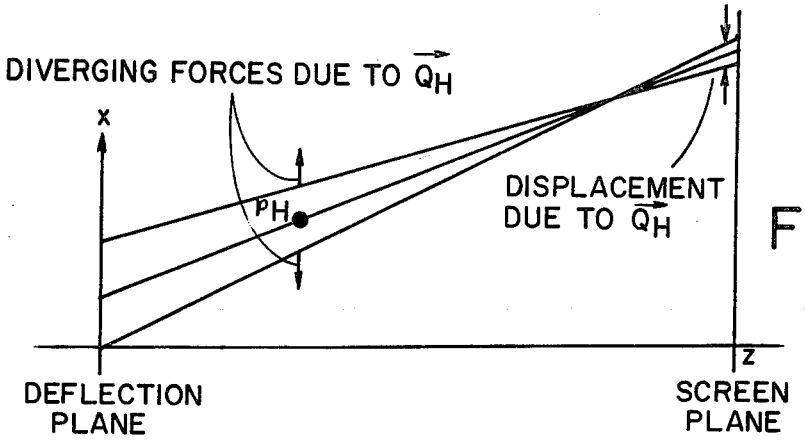

This invention relates to the production of self-converged color CRT display systems, and in particular to a method of reducing the effects of off-axis deflection defocusing of the electron beams in such systems. FIGS. 1–3 illustrate a color CRT display of the self-converged type to which this invention is applicable. Briefly, the illustrated system comprises a tube envelope 20, on the neck 21 of which is mounted a magnetic yoke assembly 22, a color purity/static convergence assembly 24 and a printed circuit board assembly 26.

In FIG. 1 the forward part of the envelope 20 is broken open to show the CRT faceplate 30, a phosphor screen 31 on the inner surface of the faceplate 30, a shadow mask 32 spaced from the screen, and three coplanar "in-line" electron beams 36, 38 and 40 generated by an electron gun assembly 42 in the neck 21 of the tube (see FIG. 2).

Also shown on the tube (FIG. 1) is a bundle of yoke leads 44 and a high voltage connector 46 through which the anode voltage is brought through the tube envelope for application to the screen 31. A base for the tube is shown at 47.

Certain of the display system components outlined above will now be discussed in more detail. The yoke assembly 22 is illustrated as including a yoke of the "hybrid" type having toroidal-type deflection vertical coils and "saddle" type horizontal deflection coils. As will be described in more detail hereinafter, the yoke is of the self-converging type and contains windings which produce an astigmatic field component having the effect of maintaining the beams in convergence as they are swept across the screen. The astigmatic field component which self-converges the beams undesirably introduces an astigmatic deflection defocusing of the beams when the beams are deflected off the tube axis, as will be explained in detail hereinafter.

The yoke assembly 22 is adjustably mounted on the outer surface of the tube envelope 20 by means of a yoke mounting device 48. The illustrated yoke mounting device is described and claimed in U.S. Pat. No. 4,006,301, assigned to the assignee of the present application.

In order to effect static convergence of the beams and to adjust the "color purity" of the reproduced images, the purity/static convergence assembly 24 is illustrated as comprising three components—a bi-polar purity adjustment component 52, and quadrupolar and sextipolar static convergence adjustment components 54, 56. The components 52, 54 and 56 are mounted on a carriage 58. The purity/static convergence assembly 24 is disclosed in detail and claimed in U.S. Pat. No. 4,050,041, assigned to the assignee of the present application.

Each of the components 52, 54 and 56 includes a drive gear, two of which are shown at 60 and 62, and a pair of facing ring holders 64, 66. The pairs of holders have retained concentrically therein pairs of thin annular magnets 68, 70, 72 having magnetic poles (two, four or six as the case may be) which are formed therein for producing corrective magnetic fields for the beams from the in-line guns. The magnets 68, 70 having gearing driven by the drive gears.

The forward ring holder 66 for the purity component 52 is affixed to the carriage 58 such that when the associated drive gear is rotated, only the geared magnets 68 rotate. The quadrupolar and sextipolar convergence adjustment components 54 and 56 on the other hand, are each supported for collective rotational movement about the neck of the tube. Each of the paired magnets 68 comprising the bi-polar purity adjustment component 52 have two poles; the magnets 70 in the static convergence component 54 have four poles; the paired magnets 72 comprising the static convergence component 56 have six poles. The ring gear drive arrangement for each of the components 52, 54 and 56 causes the related pairs of like magnets to be driven in opposite rotational directions when the associated drive gear is turned. (In the case of component 52, the contra-rotational movement is relative only.) As the related pairs of multipolar magnets are contra-rotated, their respective fields either align or cancel, permitting a resultant magnetic field of any desired strength to be obtained. By the provision of additional means allowing the static convergence adjustment components 54 and 56 to be rotated together around the neck of the tube, the selected resultant static magnetic field in these components can be oriented in any desired azimuthal orientation. Thus by appropriate control of the relative rotational positions of the paired magnets in each of the components 52, 54 and 56, and by adjustment of the collective rotational position of the components 54 and 56, the three in-line electron beams can be shifted in unisom from side to side to effect purity control and, by means of components 54 and 56, can be moved each relative to the other to effect convergence of the beams at the screen.

The electron gun assembly 42 may be of any of a variety of types but is here shown as being a high performance gun manufactured and sold by the assignee of the present invention and fully disclosed and claimed in U.S. Pat. No. 3,995,194-Blacker et al. A detailed description of the gun assembly 42 is not necessary to an understanding of the present invention. It is of interest to understand, however, that most in-line type electron guns (the gun assembly 42 included) provide beam convergence. In the illustrated gun assembly 42 the last two electrodes of the main focus lens, here labeled electrodes G5 and G6, are structured such that the gap therebetween, in the regions where the outer electron beams 36, 40 pass through, is skewed slightly with respect to the other interelectrode gaps in the gun. The skewing of the G5–G6 gap produces an asymmetrical field component which bends the outer beams 36 and 40 inwardly to produce the desired nominal convergence of the three beams at the screen. This structure for converging the electron beams is described fully and claimed in U.S. Pat. No. 4,058,753, assigned to the assignee of the present application. By virtue of the gun assembly 42 providing beam convergence, the amount of static beam convergence adjustment which must be provided by the static convergence adjustment components 54 and 56 is vastly reduced.

It is conventional during manufacture of a color CRT display system, after the display system has been assembled, to "set-up" the system by adjusting the static convergence adjustment components 54 and 56 for perfect convergence (as nearly as possible) at the plane of the screen, as shown in FIG. 1.

As a result of normal manufacturing tolerances, however, there will always be in a run of production tubes a spread in the free fall convergence of the beams. As used herein, the term "free fall" convergence is used to describe a measure of convergence (actually, is misconvergence) of the two outer beams, and in particular, the horizontal component of the separation of the outer beams, at the screen center (when the yoke current is zero) and before any static convergence adjustments are made. FIG. 4 is a probability density function depicting a typical Gaussian spread of production tubes in terms of their free fall convergence. FIG. 4 shows in terms of probabilities that the number of tubes which will have a free fall convergence between specified limits on the probability density function is the area under the p(x) curve between those limits. Obviously, the total area under the curve would correspond to the total number of tubes produced. As mentioned, typically production tubes are designed nominally to have zero free fall convergence at the screen; thus, probabilistically, as many will have free fall underconvergence as free fall overconvergence, and with symmetric distribution. The static convergence adjustment components 54 and 56 are used to bring the underconverged and overconverged tubes into a state of complete convergence at the screen.

It is useful to discuss FIG. 4 in terms of an expected value and a standard deviation of free fall underconvergence at a population of tubes. The expected value, also called nominal, average, or mean, is defined from the probability density function, p(x) by: expected value of $$x = \bar{x} = \int_{-\infty}^{\infty} x\, p(x)\, dx$$

where x denotes the value of free fall underconvergence. The probability density curve, p(x), shown in FIG. 4 has its expected value of free fall underconvergence equal to zero. The standard deviation, also called sigma, relates to the spread or range of the free fall underconvergence at the population of tubes. For a Gaussian probability density function, 99.7% of the picture tube population will have free fall underconvergence within plus or minus 3 sigma units from the mean. Sigma is defined from the probability density function, p(x) by:

$$\text{sigma} = \left[\int_{-\infty}^{\infty} (x - \bar{x})^2\, p(x)\, dx\right]^{\frac{1}{2}}$$

The present invention will be described. However before getting into the details of the present invention, a background discussion useful in understanding the invention will be given.

It has been observed that deflection defocusing of the electron beam spot is measurably more severe for in-line-gun, self converging color TV systems than for conventional delta gun systems. Edge spot distortions are typically 50–100% worse for in-line-gun, self converging systems. An investigation of this phenomena has revealed that the optical astigmatisms designed into the yoke coupled with the spherical aberration associated with the gun can account for the behavior of the distortions observed. Since spherical aberration cannot be eliminated entirely but only minimized, and since the yoke astigmatisms are necessary if self convergence is to be achieved, it is virtually impossible to completely design out this deflection defocusing. A number of things can be done to alleviate the problem. First, spherical aberration should be minimized by proper design. Also, yoke astigmatisms should be designed to minimize spot distortion effects while still maintaining self convergence. In accordance with this invention, as will be described below, deflection defocusing of the electron beams can be substantially reduced by introducing static magnetic forces on the beam bundle prior to deflection to help compensate the distorting magnetic forces produced by the yoke.

To properly integrate the items above into a system design requires a detailed understanding of the deflection defocusing mechanism. This will be discussed next. The details of the present invention will then be explained in detail.

The self converging property of the deflection yoke is accomplished by appropriately shaping the magnetic field. A simplified two dimensional illustration of the magnetic field of the horizontal coil is shown in FIG. 5. The field as shown is pincushion shaped in a plane perpendicular to the tube axis. In the neighborhood of any given point, $p_H$, on the horizontal axis ($x=x_p$, $y=0$), this field can be resolved into a main, uniform component, and a smaller quadrupole like component. Referring to FIG. 6:

$$\vec{B}_H(x,y) = \vec{B}_H(x_p, 0) + [\vec{B}_H(x,y) - \vec{B}_H(x_p, 0)] = B_{HO}\, \hat{i}_y + \vec{Q}_H(x-x_p), y)$$

where $\vec{B}_H$ is the magnetic field vector $\vec{B}_{HO}$ is the main component $\vec{Q}_H$ is the quadrupole like component.

Figure 8:
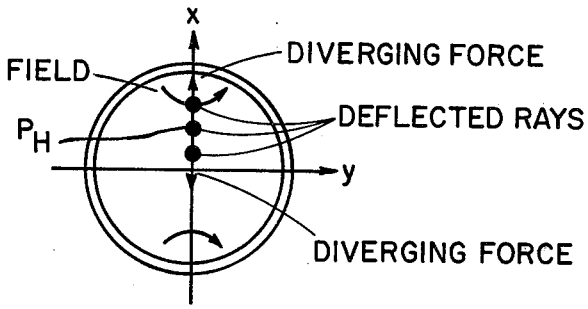

The uniform $\vec{B}_{HO}$ component is usually associated with delta gun color systems and causes, in general, overconvergence of beams with deflection. The same uniform component applied to an in-line gun arrangement will also cause overconvergence of the deflected beams as shown in FIG. 7. However, when the three beams of FIG. 7 are deflected near the point, $p_H$, and when the magnetic forces due to the $\vec{Q}_H$ components exert their influence on the beams, the result is to converge the beams as drawn in FIGS. 8 and 9. This self converging property is desired for all points on the picture tube, thus the proper $\vec{Q}$ components are designed into the yoke field for all directions of deflection and become larger with increased deflection.

Figure 10:
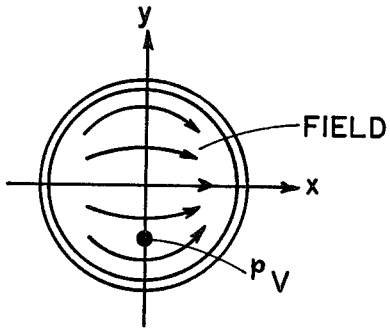

A simplified two dimensional illustration of the magnetic field of the vertical direction of deflection is shown in FIG. 10. Here the field is barrel shaped and in the neighborhood of any point, $p_V$, on the vertical axis ($x=O$, $y=y_p$) the field is resolved, like before, into a uniform component and the same type of quadrupole component $$\vec{B}_V(x,y) = \vec{B}_V(O, Y_p) + [\vec{B}_V(x,y) - B_V(O, Y_p)] = B_{VO}\, i_x + \vec{Q}_V(x, (Y-Y_p))$$

Figure 11:
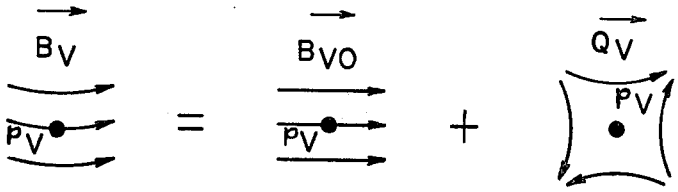

FIG. 11 illustrates this. The $\vec{Q}_V$ components will maintain self convergence when the beams are deflected near point $p_V$.

Figure 12:
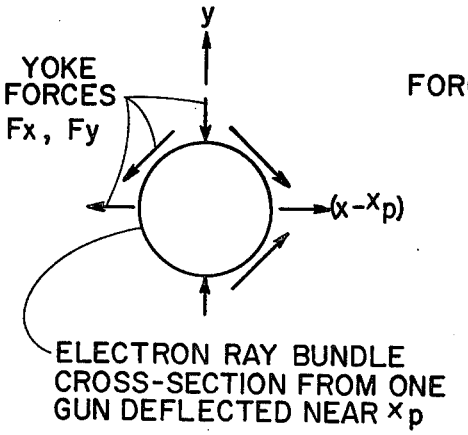
Figure 13:
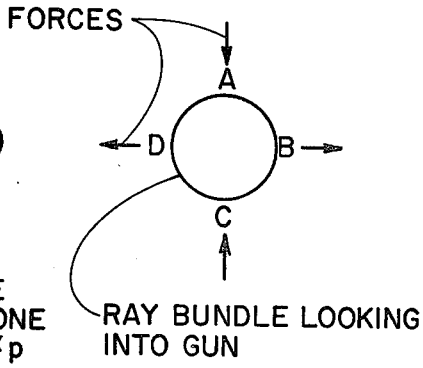
Figure 14:
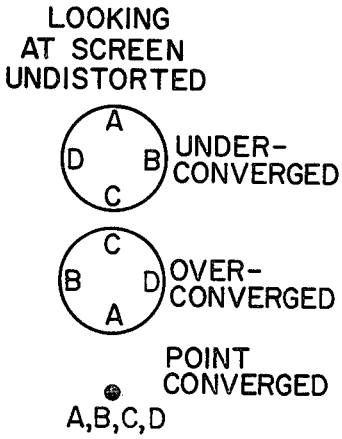
Figure 15:
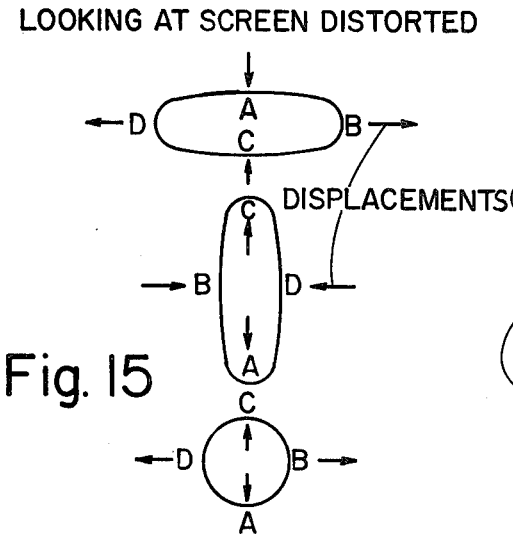
Figure 16:
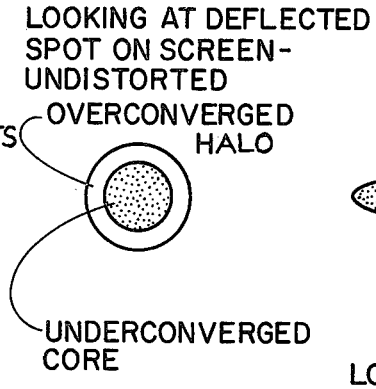
Figure 17:
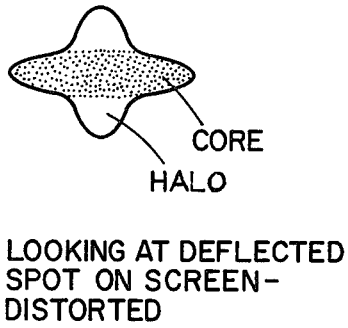

While the field shaping discussed above is desirable from the point of view of convergence of electron rays from different guns, it is undesirable for its effect on electron rays from the same gun. FIG. 12 shows the relative forces near the gun plane that are exerted on a deflected electron ray bundle from a single gun due to the above-mentioned quadrupole-like component of magnetic field. Note that the diverging forces in the horizontal direction are a scaled down version of the diverging forces that give self convergence. The magnitude of the diverging forces is proportional to the separation between them. The forces in the vertical direction will tend to converge rays and are also proportional to separation. The effect of these forces on the electron beam spot at the picture tube face is shown in FIGS. 13–15. A circle of rays that would otherwise overconverge on the screen are distorted into a vertical ellipse. A circle of rays that would otherwise underconverge are distorted into a horizontal ellipse. Finally, a circle of rays that would otherwise converge to a point on the screen, are distorted into a circle. Since spherical aberration implies a spot comprised of both overconverged rays (associated with halo) and underconverged rays (associated with core), the distortion of the beam spots on the tube face due to the yoke will be a combination of the above distortions. As shown in FIGS. 16 and 17 the spot halo is distorted vertically and the spot core is distorted horizontally. Since the yoke forces become larger with deflection, the most severe spot distortions will be seen in the corner of the tube where deflection is largest.

Figure 18:
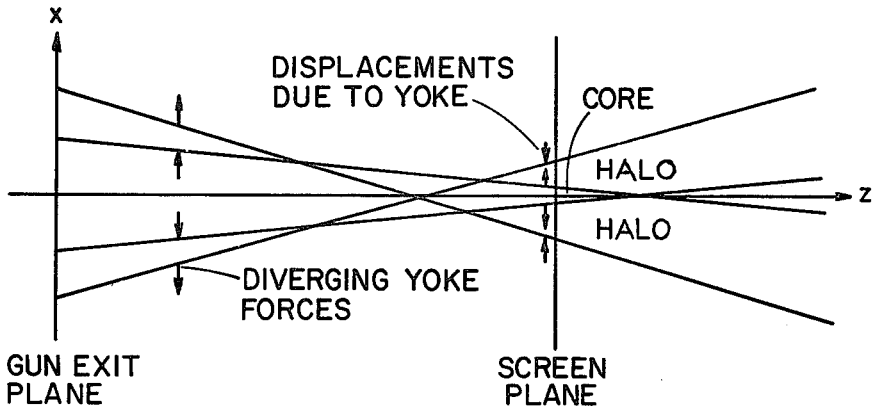

To further explain the effect of the yoke forces coupled with spherical aberration, FIG. 18 shows a schematic profile of the electron ray bundle in the horizontal plane containing the tube axis (z axis). The rays as drawn illustrate sperical aberration: the outer rays of the gun see a stronger lens action and focus at a shorter length than the inner rays. With the picture face in the position shown in the diagram the halo and core region of the spot, to spherical aberration, can be identified.

Figure 19:
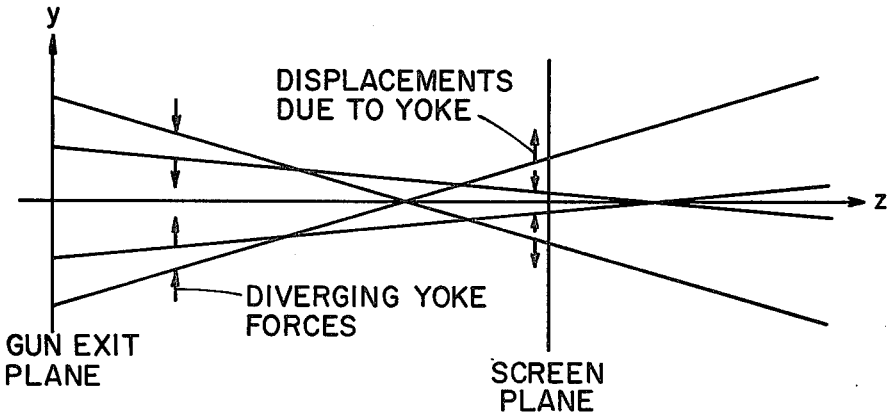

The diverging yoke forces near the gun exit plane are shown by arrows on the individual rays and the displacement at the screen due to these forces are again shown by arrows on the rays. Notice that the core becomes larger and the halo becomes smaller. Similarly FIG. 19 shows these effects as they occur in the vertical plane containing the tube axis. Here due to the converging force of the yoke the halo becomes larger and the core becomes smaller. This, then, is the mechanism of the total spot distortion of FIG. 16.

The present invention will now be described in detail. The present invention is a method of reducing the effects of off-axis deflection defocusing of the electron beams in a self-converged color CRT display system. In accordance with this invention there is installed in the neck of each color CRT bulb a three beam in-line type electron gun whose mechanical and electrical design parameters are such that the beams in their free fall state have a selected nominal value of underconvergence at the screen which is such that substantially the entire population of production tubes is underconverged. A self-converging yoke is installed on the neck of the tube; the yoke establishes, in addition to main deflection magnetic field components, an astigmatic field component which self-converges the beams, but which undesirably introduces astigmatic deflection defocusing of the beams when deflected off the tube axis. Static convergence of the beams at the screen is effected by establishing a static astigmatic quadrupolar magnetic field component common to all three beams and opposite to said astigmatic yoke field component which while accomplishing the desired static beam convergence, introduces an astigmatic distortion of said beams which is a function, for each tube, of the free fall underconvergence value for that tube. This distortion at least partially compensates deflected beams for the deflection defocusing of the beams by the oppositely directed astigmatic yoke field component.

Figure 20:
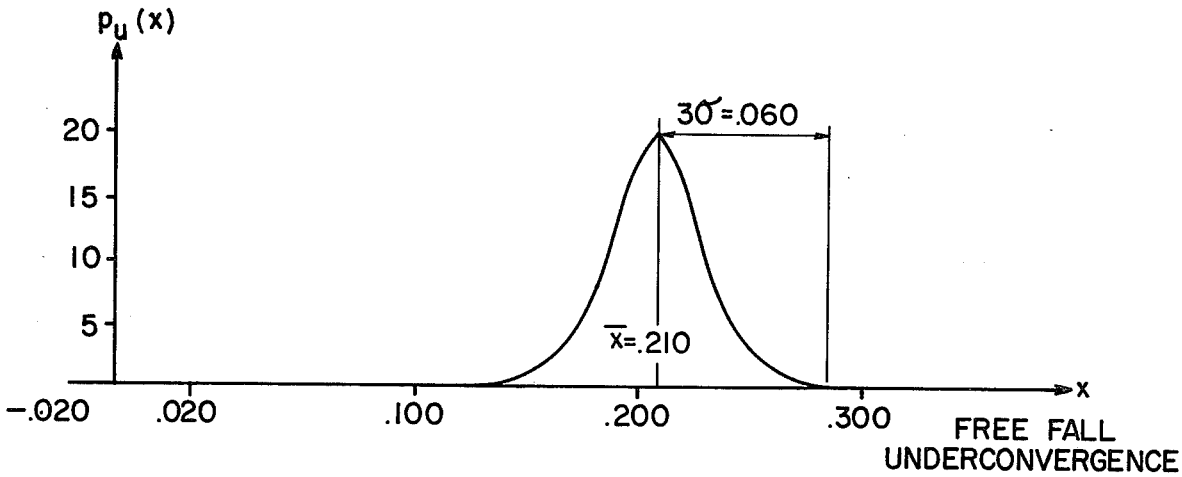
FIGS. 20 and 21 depict the free fall convergence of a run of production tubes constructed according to the method of this invention.

Stated in terms of probabilities, an electron gun is selected according to this invention to have mechanical and electrical design parameters which are such that the beams in their free fall state have a selected nominal value of underconvergence at the screen which is greater than the three sigma production spread of the free fall underconvergence of production tubes. FIG. 20 is a plot of the probability density function of a run of production tubes made according to the present invention. The horizontal axis is a plot of the free fall spacing between the two outer beams where they impact the center of the screen. The nominal value of underconvergence is stated in terms of the separation of the two outer beams in their free fall state. In the illustrated FIG. 20 example, the nominal value of underconvergence is equal to 0.210 inches. The three sigma production spread of the free fall underconvergence of the tubes graphed in FIG. 20 is approximately 0.060 inch.

It will be understood that in accordance with this invention, which static convergence of the beams in the various production tubes graphed in FIG. 20 is effected, those tubes with the least amount of free fall underconvergence will receive the least amount of static convergence correction and thus will have the lowest level of static astigmatic distortion and the lowest level of compensation for deflection defocusing of deflected beams by the yoke. Conversely, those tubes having the greatest amount of free fall underconvergence will receive the greatest amount of compensation for deflection defocusing. Reiterating, the amount of static convergence adjustment which is necessary to bring the beams into convergence at the screen determines the amount of astigmatic distortion (here vertical elongation) of the beams in their static condition. This in turn determines the level of concentration of the oppositely directly astigmatic yoke field component acting on the deflected beams. In short, the level of static convergence adjustment to bring the beams from their free fall underconverged state into convergence determines the amount of compensation for deflection defocusing of the beams by the yoke.

Figure 21:
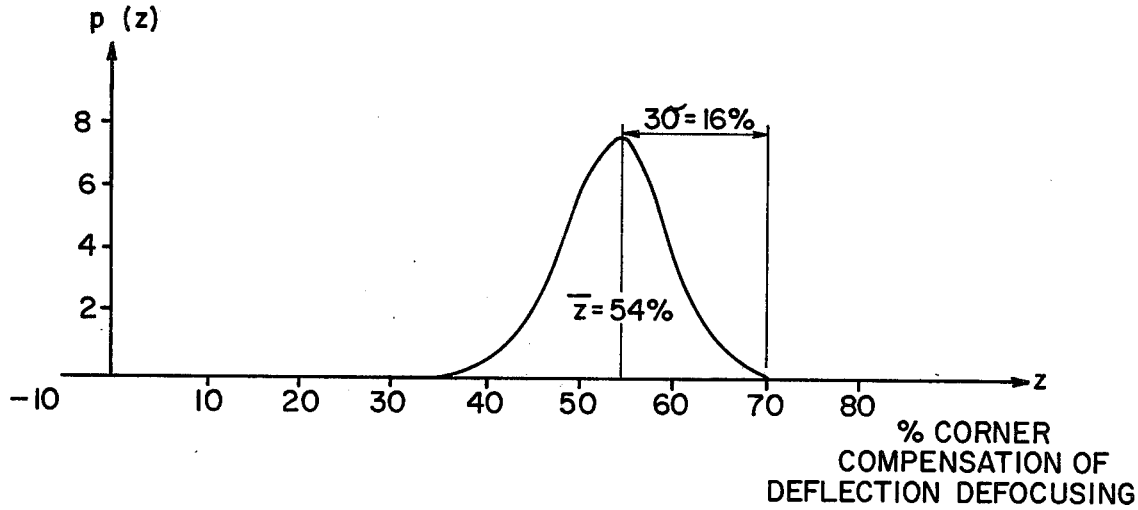

FIG. 21 is a figure related to FIG. 20 but in terms of a probability density function for deflection defocusing compensation at the corners of the screen. It can be seen that in accordance with this invention, all tubes are caused to be underconverged by some selected nominal value of underconvergence which is no less than the three sigma production spread of the free fall underconvergence of production tubes. In the illustrated example, the percentage of corner compensation for deflection defousing of beams deflected to the screen edges is approximately 54%, with a three sigma deviation of 16%. This means that substantially all tubes in the production run plotted in FIGS. 20 and 21 will have no less than 38% corner compensation at the screen edges for deflection defocusing and may have as much as 70%.

Another example of a commercially successful application of this invention is a 13 V, 100°—deflection color CRT wherein the nominal design underconvergence is 0.230 inch, ±0.70 inch outer beam spacing at the screen, resulting in a corner deflection defocusing compensation at the screen edges of 68%±21%. Yet another production utilization of the invention is a 25 V, 100°—deflection color CRT wherein the design underconvergence is 0.135±0.050 inch outer beam spacing at the screen, resulting in a corner deflection defocusing compensation of 30%±11%.

In accordance with this invention the selected nominal value of underconvergence at the screen is a value which produces a level of compensation for deflection defocusing at the screen edges of between 25% and 75%. It has been found that as a practical matter, a nominal level of corner compensation for deflection defocusing of the deflected beams at the screen edges of less than 25%, while significant, is not readily perceptible to the average viewer. On the other hand, a level of corner compensation of greater than 75% produces an extreme condition in which the corner-to-center ratio of final astigmatic distortion is equal to or less than 1. Stated another way, in this condition the vertical elongation (astigmatic distortion) of the beams which results when the static convergence adjustment of underconverged beams is applied is as great or greater than the distortion of the beams at the screen edges due to deflection defocusing and astigmatism from the static convergence component. Since the center of the screen is so much more important than the screen edges in terms of apparent picture quality (due to the fact that the center of the screen is "where the action is"), it would be unthinkable to introduce a center screen beam spot distortion which is so great as to make the center of the picture no sharper than the edges of the picture.

By way of example, the present invention may be practiced in a 19 V, 100°—deflection tube by employing a gun assembly 42 of the character described above havng the following specifications:

Throw distance-11.685 inches
Beam-to-beam spacing at gun-0.270 inches
$G_5$–$G_6$ gap angle ("b" in FIG. 3)—1°30′
Voltage on $G_5$—12.5KV
Voltage on $G_6$—30KV
Free fall underconvergence (outer beam spacing at screen)-0.210 inch
Free fall beam angle (angle "a" in FIG. 3)—0.81°

It is of interest to note that according to conventional practice wherein the electrical and mechanical design parameters of the gun are set for zero nominal free fall convergence at the screen, the static convergence adjustment devices are useful only for adjustment of the tolerance-extreme tubes. Those tubes which fall on or near nominal, in effect, have convergence adjustment components which is of no use. According to the present invention, the static convergence adjustment components perform a dual function for every tube. First, they are used to bring the beams from their free fall underconverged state into convergence. Secondly, in every case according to this invention they introduce a deliberate astigmatism to the beams which results in a compensation at the screen edges for deflection defocusing of the beams by the yoke.

It is important to know also that the amount of astigmatism of the center beams deliberately introduced by this invention when the static convergence adjustment devices are adjusted is less by a factor of approximately 2 to 1 than the deflection defocusing compensation produced at the screen edges. In other words, according to this invention, for a given tube which receives a 50% deflection defocusing compensation at the screen edges, the vertical elongation of the center beams introduced by adjustment of the static convergence component will be roughly half that great. In short, by the practice of this invention a modest compromise in picture resolution in the center of the screen is traded off for a very much larger compensation at the screen edges for the deflection defocusing introduced by the self-converging yoke.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. In the production of self-converged color CRT display systems, a method of reducing the effects of off-axis deflection defocusing of the electron beams in said systems, comprising:

installing in the neck of each color CRT bulb a three beam in-line-type electron gun whose mechanical and electrical design parameters are such that the beams in their free fall state have a selected nominal value of underconvergence at the screen which is such that substantially the entire population of production tubes is underconverged;

installing on the neck of each tube a self-converging yoke which establishes, in addition to main deflection magnetic field components, an astigmatic field component which self-converges said beams, but which undesirably introduces astigmatic deflection defocusing of the beams when deflected off the tube axis; and effecting static convergence of said beams at said screen by establishing a static astigmatic quadrupolar magnetic field component common to all three beams and opposite to said astigmatic yoke field component which, while accomplishing the desired static beam convergence, deliberately introduces an astigmatic distortion of said beams which is a function, for each tube, of the free fall underconvergence value for that tube, said distortion at least partially compensating the deflected beams for the deflection defocusing of the beams by the oppositely directed astigmatic yoke field component.

2. In the production of self-converged color CRT display systems, a method of reducing the effects of off-axis deflection defocusing of the electron beams in said systems comprising:

installing in the neck of each color CRT bulb a three beam in-line-type electron gun whose mechanical and electrical design parameters are such that the beams in their free fall state have a selected nominal value of underconvergence at the screen which is greater than the three sigma production spread of the free fall underconvergence of production tubes;

installing on the neck of each tube a self-converging yoke which establishes, in addition to main deflection magnetic field components, an astigmatic field component which self-converges said beams, but which undesirably introduces astigmatic deflection defocusing of the beams when deflected off the tube axis; and effecting static convergence of said beams at said screen by establishing a static astigmatic quadrupolar magnetic field component common to all three beams and opposite to said astigmatic yoke field component which, while accomplishing the desired static beam convergence, deliberately introduces an astigmatic distortion of said beams which is a function, for each tube, of the free fall underconvergence value for that tube, said distortion at least partially compensating deflected beams for the deflection defocusing of the beams by the oppositely directed astigmatic yoke field component.

3. In the production of self-converged color CRT display systems, a method reducing the effects of off-axis deflection defocusing of the electron beams in said systems, comprising:

installing in the neck of each color CRT bulb a three beam in-line-type electron gun whose mechanical and electrical design parameters are such that the beams in their free fall state have a selected nominal value of underconvergence at the screen, as hereinafter defined;

installing on the neck of each tube a self-converging yoke which establishes, in addition to main deflection magnetic field components, an astigmatic field component which self-converges said beams, but which undesirably introduces astigmatic deflection defocusing of the beams when deflected off the tube axis; and effecting static convergence of said beams at said screen by establishing a static astigmatic quadrupolar magnetic field component common to all three beams and opposite to said astigmatic yoke field component which, while accomplishing the desired static beam convergence, introduces an astigmatic distortion of said beams which is a function, for each tube, of the free fall underconvergence value for that tube, said distortion at least partially compensating deflected beams for the deflection defocusing of the beams by the oppositely directed astimatic yoke field component, said selected nominal value of underconvergence at the screen being a value which produces a nominal level of corner compensation for deflection defocusing of deflected beams of between 25% and 75%.

* * * * *